US012264560B2

(12) United States Patent
Langlais

(10) Patent No.: US 12,264,560 B2
(45) Date of Patent: Apr. 1, 2025

(54) TORQUE RESISTANT SHROUD SYSTEM

(71) Applicant: Schlumberger Technology Corporation, Sugar Land, TX (US)

(72) Inventor: Michael Dean Langlais, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/557,825

(22) PCT Filed: Apr. 19, 2022

(86) PCT No.: PCT/US2022/025265
§ 371 (c)(1),
(2) Date: Oct. 27, 2023

(87) PCT Pub. No.: WO2022/235425
PCT Pub. Date: Nov. 10, 2022

(65) Prior Publication Data

US 2024/0240543 A1 Jul. 18, 2024

Related U.S. Application Data

(60) Provisional application No. 63/183,656, filed on May 4, 2021.

(51) Int. Cl.
*E21B 43/10* (2006.01)
*E21B 43/08* (2006.01)

(52) U.S. Cl.
CPC ..... *E21B 43/10* (2013.01); *E21B 43/086* (2013.01)

(58) Field of Classification Search
CPC ..... E21B 43/10; E21B 43/086
See application file for complete search history.

(56) References Cited

U.S. PATENT DOCUMENTS

| | | | | |
|---|---|---|---|---|
| 9,562,402 | B2 | 2/2017 | Vu | |
| 10,920,537 | B2 | 2/2021 | Sessa | |
| 11,525,340 | B2 | 12/2022 | Langlais | |
| 2010/0018697 | A1 | 1/2010 | Richards | |
| 2015/0060059 | A1* | 3/2015 | Langlais | E21B 43/08 166/227 |

(Continued)

OTHER PUBLICATIONS

International search report and Written Opinion issued in the PCT Application PCT/US2022/025265, dated Aug. 2, 2022 (11 pages).

*Primary Examiner* — Shane Bomar
(74) *Attorney, Agent, or Firm* — Michael Wills, III; Jeffrey D. Frantz

(57) ABSTRACT

A technique facilitates installation of a completion system having sequentially coupled base pipes and a corresponding alternate path system having alternate path shunt tubes. Sequential base pipes may be joined via a base pipe coupling. The alternate path shunt tubes disposed along sequential base pipes are then connected by jumper tubes. Additionally, the base pipe coupling and the jumper tubes are enclosed with a multi-section shroud by closing shroud sections over the base pipe coupling and the jumper tubes. A torque resistance system is employed to provide torsional rigidity along the shroud.

19 Claims, 10 Drawing Sheets

(56) References Cited

U.S. PATENT DOCUMENTS

| | | | | |
|---|---|---|---|---|
| 2015/0226040 | A1* | 8/2015 | McNamee | E21B 17/1078 166/278 |
| 2015/0233215 | A1* | 8/2015 | Yeh | E21B 43/04 166/278 |
| 2016/0290110 | A1* | 10/2016 | Novelen | E21B 43/084 |
| 2017/0058647 | A1 | 3/2017 | Langlais | |
| 2018/0274340 | A1 | 9/2018 | Stolboushkin | |
| 2018/0298730 | A1 | 10/2018 | Sessa | |
| 2020/0224528 | A1* | 7/2020 | Fripp | E21B 47/01 |
| 2021/0123327 | A1 | 4/2021 | Langlais et al. | |
| 2021/0324712 | A1* | 10/2021 | Sladic | E21B 43/088 |

* cited by examiner

TORQUE RESISTANT SHROUD SYSTEM

CROSS-REFERENCE TO RELATED APPLICATIONS

The present application is a National Stage Entry of International Application No. PCT/US2022/025265, filed Apr. 19, 2022, which claims priority benefit of Provisional Application No. 63/183,656, filed May 4, 2021, the entirety of which is incorporated by reference herein and should be considered part of this specification.

BACKGROUND

In a variety of well applications, gravel packing operations are performed across well zones along a wellbore. Gravel packing equipment is deployed downhole via a suitable well string to facilitate gravel packing along the wellbore between the well string and the surrounding wellbore wall. The gravel packing equipment may comprise a downhole completion with screen assemblies combined with an alternate path system which facilitates uniform gravel packing along the wellbore. In open hole applications, the screen assemblies may be formed as open hole alternate path shunted screens enclosed in a perforated sheet metal tube often referred to as a shroud. The perforated shroud of each screen assembly provides a smooth outer covering to prevent hang-ups on the underlying shunt tube system components while running the alternate path screens through the open hole to a target depth. The perforations in the shroud allow fluid to flow inwards towards a screen/filter or outwards toward the wellbore annulus.

The screen assemblies each have shunt tubes mounted about a base pipe and the base pipe extends from the shroud to provide an unshrouded area designed to facilitate rig operations when connecting sequential joints of the base pipe. After connecting the sequential base pipes, the shunt tubes of sequential screen assemblies/joints may then be fluidly connected by installing jumper tubes. After installation of the jumper tubes, this handling area is covered by a section of shroud, e.g. a split shroud. However, the shroud installed over this handling area tends to be a weak link in the overall completion system because of its reduced capacity for withstanding high torque loads.

SUMMARY

In general, a system and methodology facilitate installation of a completion system having sequentially coupled base pipes and a corresponding alternate path system comprising alternate path shunt tubes. Sequential base pipes may be joined via a base pipe coupling. The alternate path shunt tubes disposed along sequential base pipes are then connected by jumper tubes. Additionally, the base pipe coupling and the jumper tubes are enclosed with a multi-section shroud by closing shroud sections over the base pipe coupling and the jumper tubes. A torque resistance system may be employed to provide torsional rigidity along the shroud. The torque resistance system is constructed such that closing the shroud sections automatically engages the torque resistance system between the shroud and the base pipe to thus utilize the base pipe in protecting the shroud and the jumper tubes against unwanted effects of torque acting on the overall completion system.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
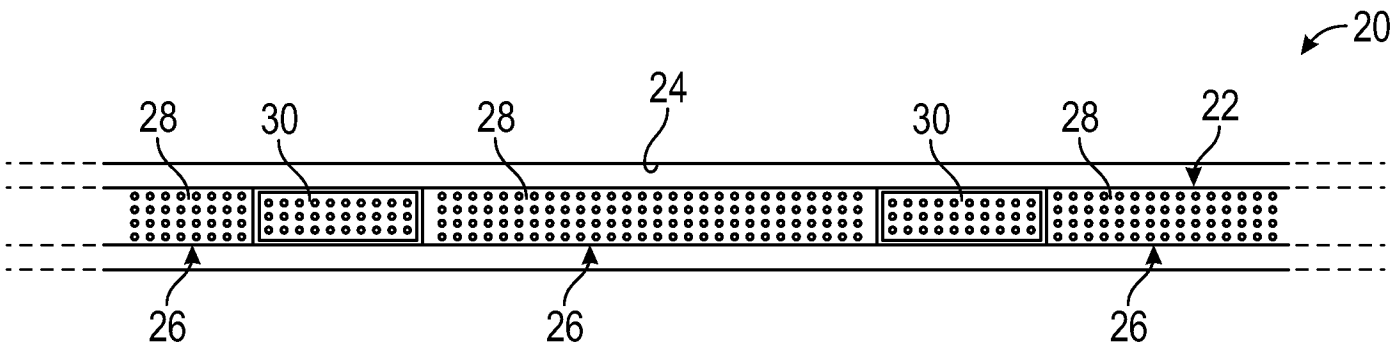
FIG. 1 is an illustration of an example of a completion system positioned downhole in a wellbore and comprising screen assemblies/joints coupled together and protected by outer screen shrouds and jumper tube shrouds, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology which facilitate installation of a completion system having sequentially coupled base pipes and a corresponding alternate path system comprising alternate path shunt tubes. Individual base pipes along with their corresponding alternate path shunt tubes may be combined with screens and corresponding screen shrouds to form screen assemblies. The screen shrouds may be formed from a perforated sheet metal tube so as to enable inflow/outflow of fluid during, for example, a gravel packing operation, a later production operation, and/or other well operations. In open hole applications, the screen assemblies may be referred to as open hole alternate path shunted screen assemblies or as open hole alternate path shunted screen joints.

The sequential base pipes of sequential screen assemblies may be joined via a base pipe coupling. The alternate path shunt tubes disposed along sequential base pipes are then connected by jumper tubes. Additionally, the base pipe coupling and the jumper tubes are enclosed with a multi-section shroud by closing shroud sections over the base pipe coupling and the jumper tubes. A torque resistance system is employed to provide torsional rigidity along the shroud. The torque resistance system may be constructed such that closing the shroud sections automatically engages the torque resistance system between the shroud and the base pipe to thus utilize the base pipe in protecting the shroud and the jumper tubes against unwanted effects of torque acting on the overall completion system.

In some embodiments, the multi-section shroud is formed as a split-shroud having two sections, e.g. two halves, hinged together such that they can be installed radially and then swung closed and bolted or otherwise secured together. The torque resistance system works in cooperation with the multi-section shroud and the base pipe to provide substantially enhanced torque capacity and to thus protect the shroud and the jumper tubes during installation of the completion system. When running the completion system in hole, for example, the completion system may become stuck or restricted from moving forward. The completion system is sometimes rotated to free it from being stuck or restricted. It should be noted the rotation is generally in the clockwise direction to avoid inadvertently unthreading a connection within the completion system, e.g. unthreading a coupling between base pipes. The clockwise rotation results in a counterclockwise torque reaction on the multi-section shroud but the torque resistance system functions to reduce or eliminate the detrimental effects of the counterclockwise torque.

Referring generally to FIG. 1, an example of a well system 20 is illustrated as comprising a completion system 22 deployed in a borehole 24, e.g. a wellbore. In the illustrated embodiment, completion system 22 comprises a plurality of screen assemblies 26 coupled together and deployed along the interior of the borehole 24 to a desired target depth. As explained in greater detail below, each screen assembly 26 comprises shunt tubes of an alternate path system and these shunt tubes are joined by jumper tubes. Each screen assembly 26 also has a screen shroud 28 which encloses and protects the shunt tubes while providing a smooth outer surface. The jumper tubes are similarly enclosed via corresponding multi-section shrouds 30, e.g. split shrouds. The shrouds 30 work in cooperation with torque resistance systems to reduce or eliminate unwanted torque effects due to the torque which results during twisting of completion system 22.

Figure 2:
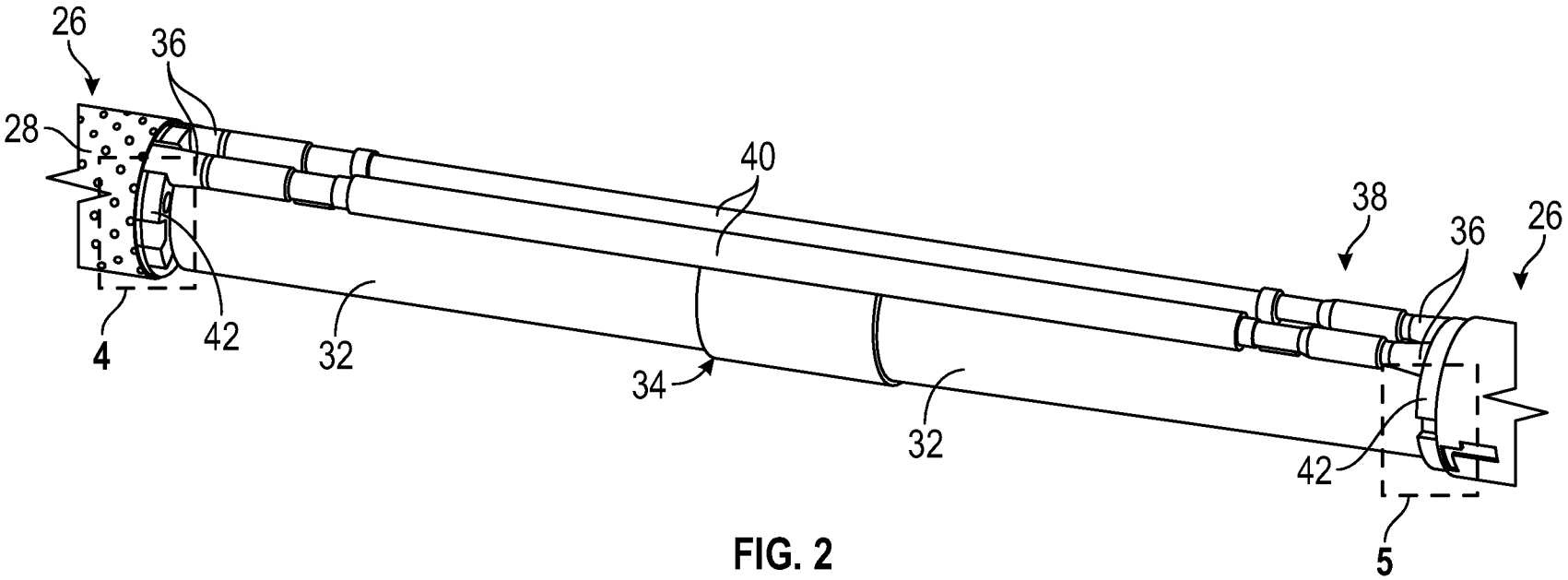
FIG. 2 is an illustration of an example of sequential screen assemblies coupled together by a base pipe coupling and by jumper tubes extending between corresponding shunt tubes of an alternate path system, according to an embodiment of the disclosure.
Figure 3:
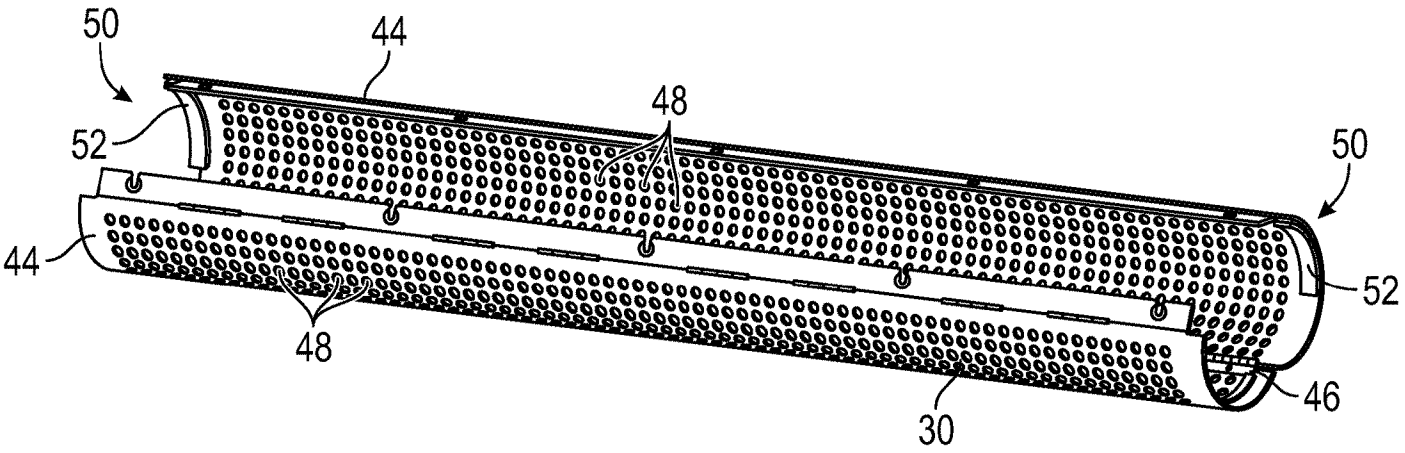
FIG. 3 is an illustration of an example of a shroud having shroud sections which may be closed over the jumper tubes and the base pipe coupling, the shroud including a portion of a torque resistance system, according to an embodiment of the disclosure.

Referring generally to FIGS. 2-5, an example is illustrated of two sequential screen assemblies 26 having base pipes 32 which are joined at a base pipe coupling 34, e.g. a box and pin end coupling. Each base pipe 32 is combined with shunt tubes 36 of an overall alternate path system 38 used, for example, to facilitate uniform gravel packing between the completion system 22 and the surrounding wall of wellbore 24. The base pipe 32 and its corresponding shunt tubes 36 are enclosed by the corresponding screen shroud 28 and various screens/filters and other components may be disposed between the base pipe 32 and the external screen shroud 28. As illustrated in FIG. 2, the ends of the base pipes 32 extend from their corresponding screen shrouds 28 to facilitate coupling via base pipe coupling 34. This exposed area provides a base pipe handling area to facilitate rig operations during connection of the base pipes 32 and assembly of the completion system 22. After sequential base pipes 32 are joined via coupling 34, jumper tubes 40 may be coupled between corresponding shunt tubes 36 to provide the desired flow path along the alternate path system 38.

In the embodiment illustrated, the shunt tubes 36 and jumper tubes 40 are supported along the exterior of base pipes 32 via support rings 42. After installation of the jumper tubes 40, the shroud 30 may be installed over the jumper tubes 40 and over base pipe coupling 34. In the illustrated example, the shroud 30 is a multi-section shroud having a plurality of shroud sections 44 which may be transitioned between open and closed positions. By way of example, the shroud 30 may be in the form of a split shroud having two shroud sections 44 coupled to each other via a shroud hinge 46. The shroud sections 44 may have perforations 48 to facilitate fluid flow therethrough.

As further illustrated in FIGS. 2-5, the completion system 22 also comprises a torque resistance system 50 positioned at, for example, each shroud 30. The torque resistance system 50 acts between the shroud 30 and the base pipe or base pipes 32 to resist unwanted torque effects in the region of the jumper tubes 40/shroud 30 during twisting/rotation of completion system 22. It should be noted that with the introduction of extended reach alternate path systems, operators benefit from the robust system provided by torque resistance system 50 to better enable pushing and rotating the completion system 22, thus ensuring traversing of extended reaches and ultimately reaching target depth. In the illustrated embodiment, the torque resistance system 50 comprises a torque block 52 or a plurality of torque blocks 52 secured along an interior of the shroud 30. In the example illustrated, two torque blocks 52 are secured to the interior of shroud 30 proximate longitudinal ends of shroud 30 (see FIG. 3). The torque block(s) 52 may be affixed to shroud 30 via welding, fasteners, or other suitable attachment techniques. In some embodiments, the two or more torque blocks 52 have differing lengths and/or different sizes. For example, the two or more torque blocks 52 may have an arc length that is sufficient for the implemented attachment technique that still meets the torque requirements of the particular application.

Figure 5:
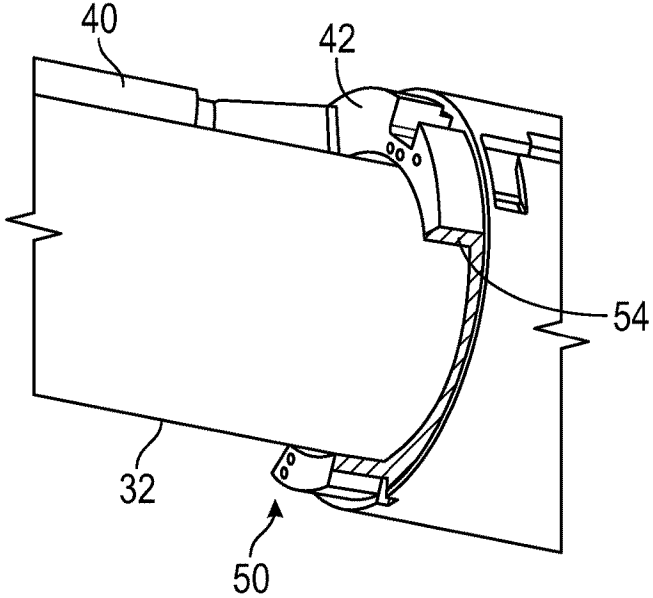
FIG. 5 is an illustration of an example of a portion of a torque resistance system, according to an embodiment of the disclosure.
Figure 4:
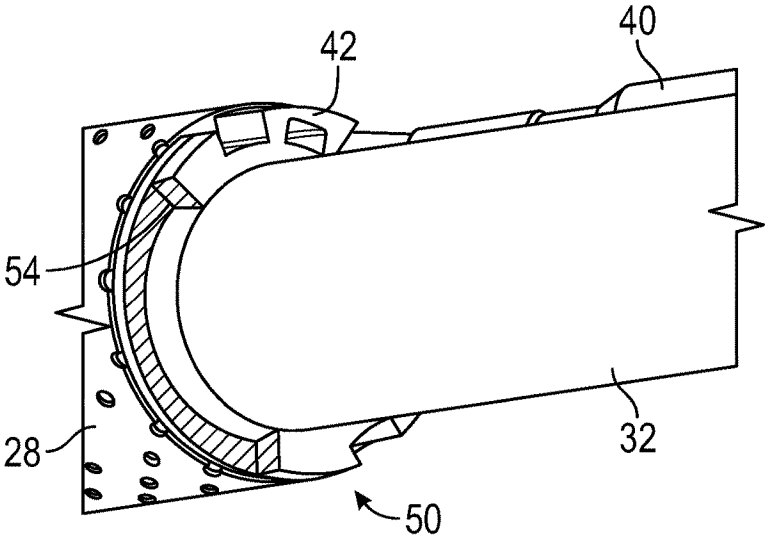
FIG. 4 is an illustration of an example of a portion of a torque resistance system, according to an embodiment of the disclosure.
Figure 6:
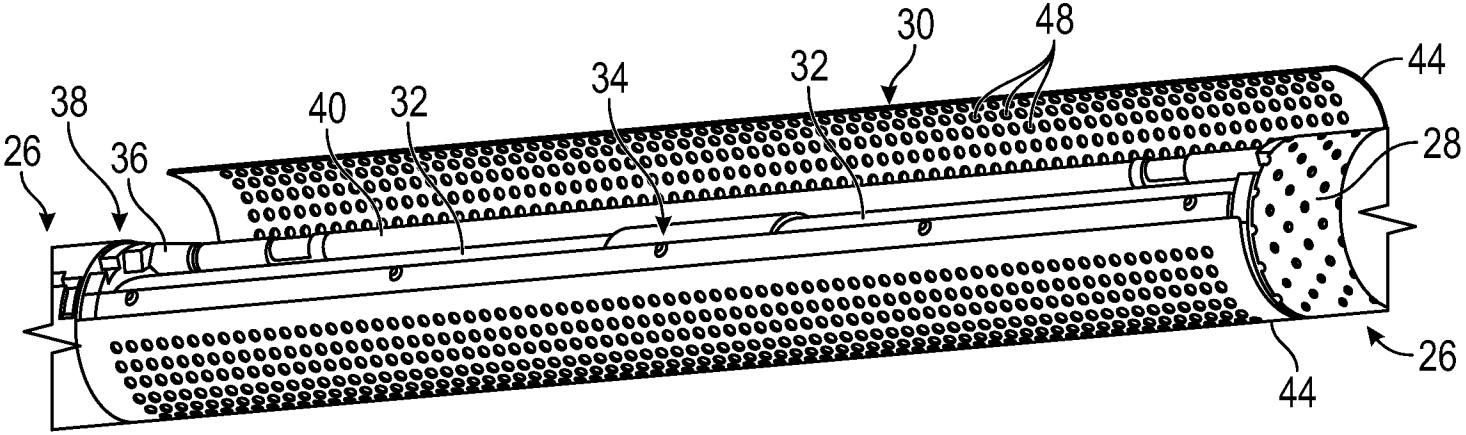
FIG. 6 is an illustration of the shroud (shown in FIG. 3) being closed over the base pipe coupling and jumper tubes illustrated in FIG. 2, according to an embodiment of the disclosure.
Figure 7:
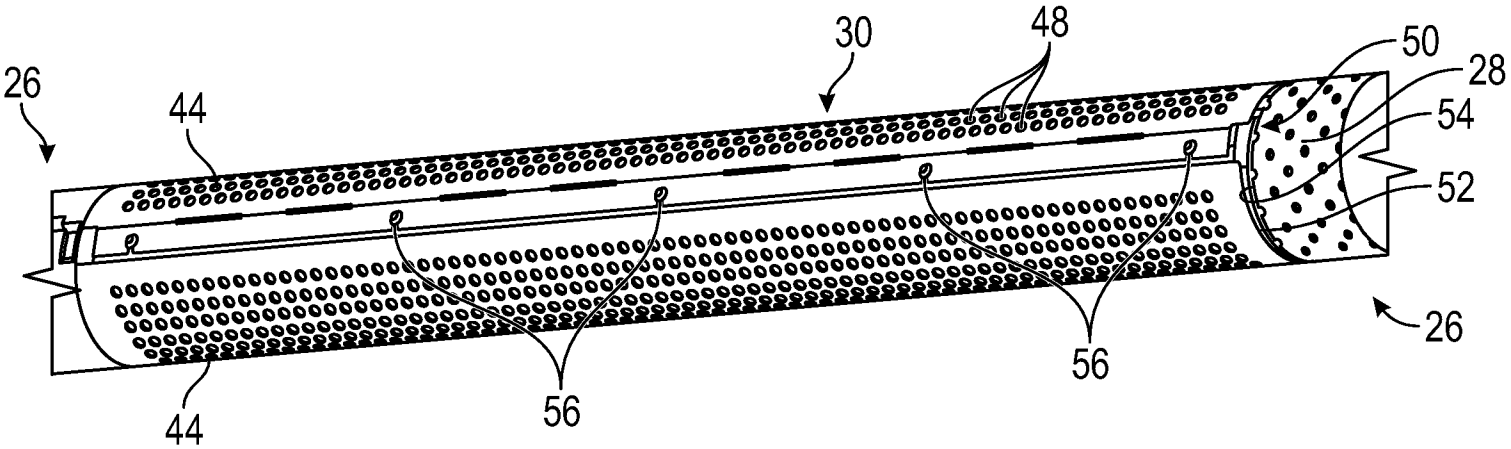
FIG. 7 is an illustration of the shroud in a fully closed position to automatically engage the torque resistance system, according to an embodiment of the disclosure.
Figure 8:
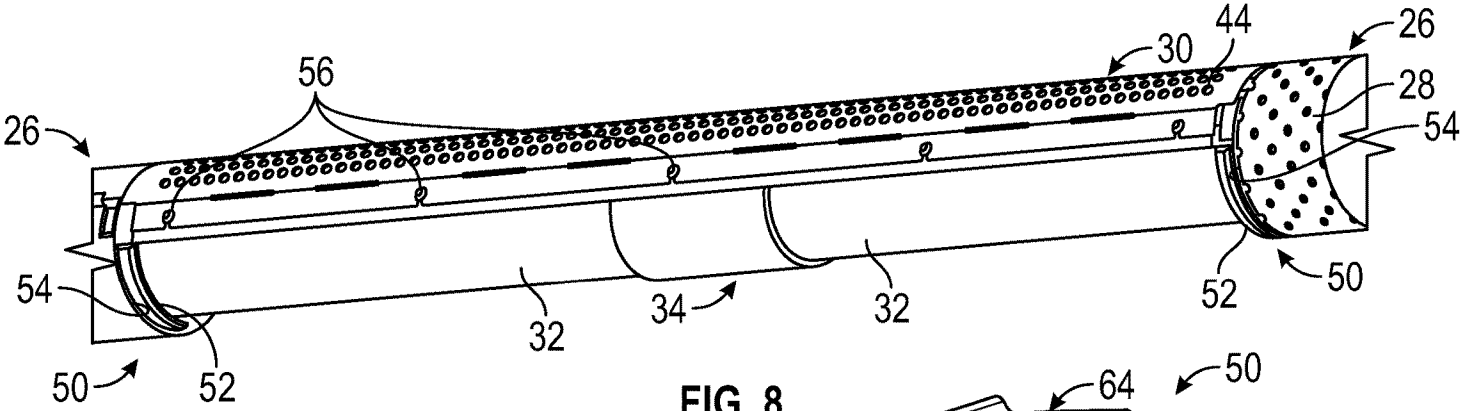
FIG. 8 is an illustration in which a portion of the shroud has been broken away to better illustrate the torque resistance system in an engaged position, according to an embodiment of the disclosure.
Figure 9:
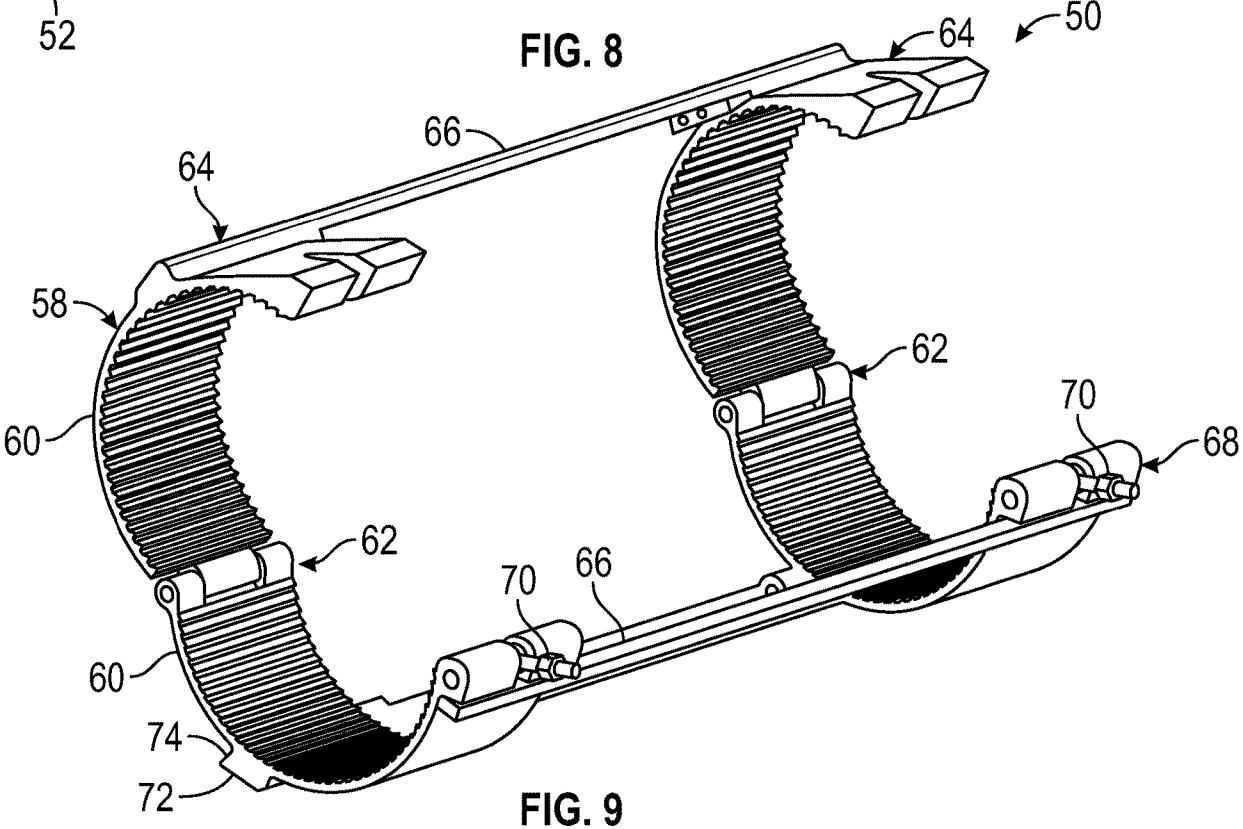
FIG. 9 is an illustration of a base pipe clamp which may be used in another embodiment of the torque resistance system, according to an embodiment of the disclosure.
Figure 10:
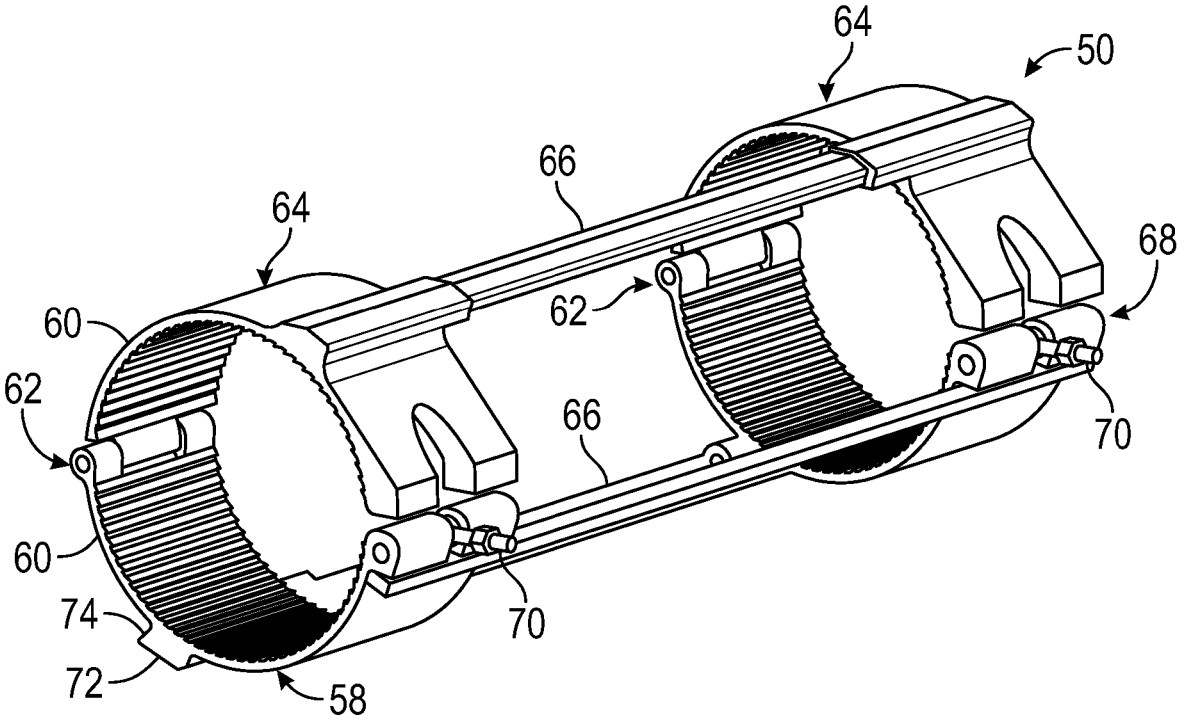
FIG. 10 is an illustration of the base pipe clamp of FIG. 9 but shown in a closed position, according to an embodiment of the disclosure.
Figure 11:
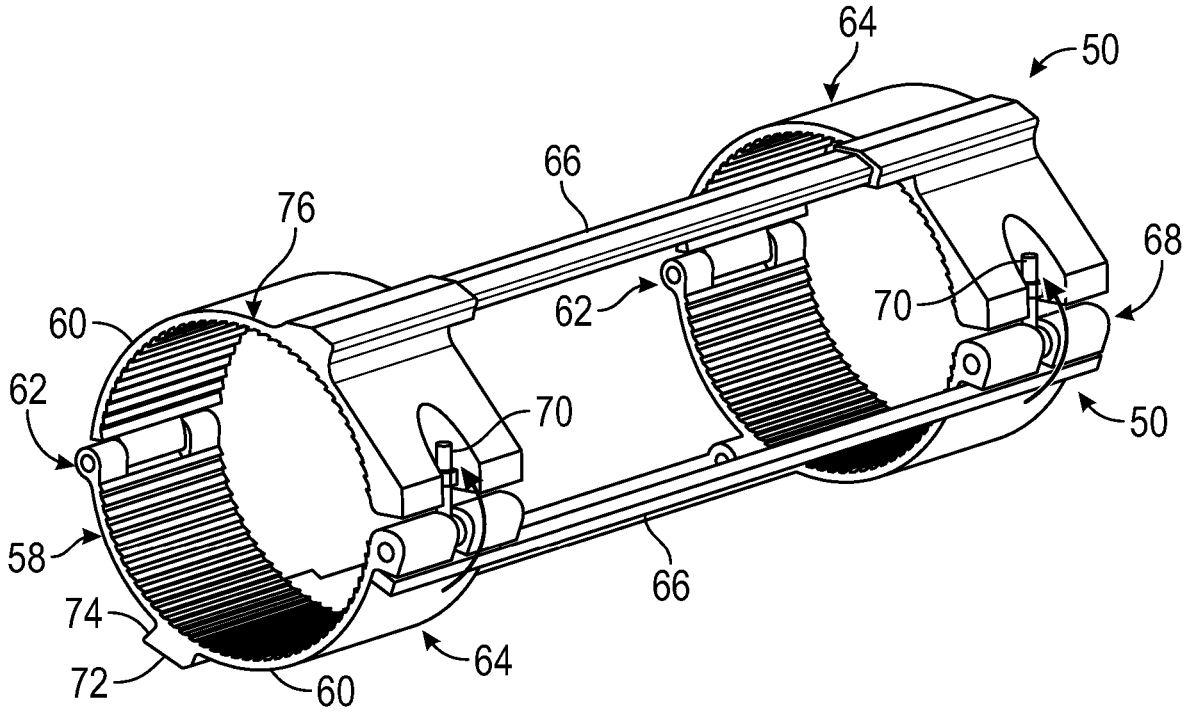
FIG. 11 is an illustration of the base pipe clamp of FIG. 10 with latches actuated to secure the pipe clamp in the closed position, according to an embodiment of the disclosure.
Figure 12:
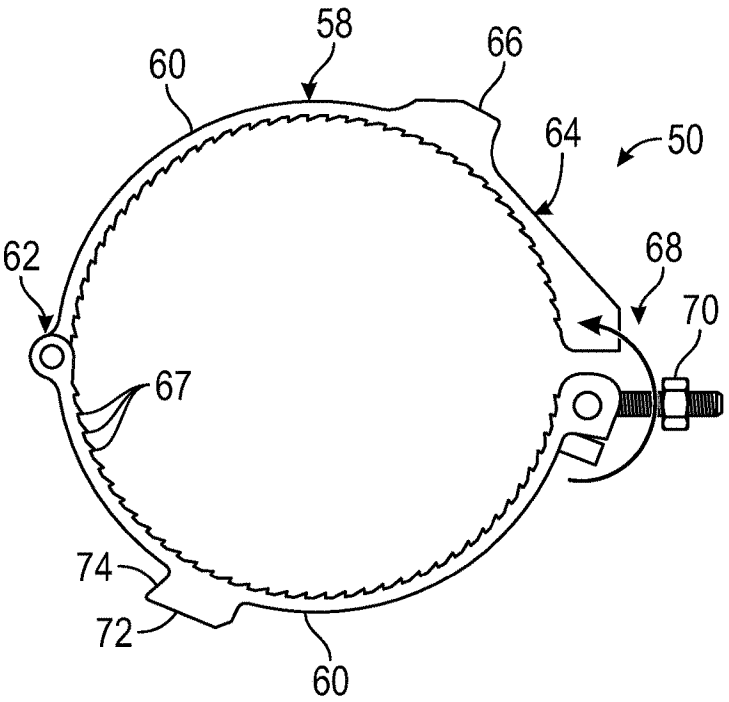
FIG. 12 is an end view of the base pipe clamp illustrated in FIG. 10, according to an embodiment of the disclosure.

As best illustrated in FIGS. 4 and 5, the torque resistance system 50 further comprises pockets/recesses 54 sized to receive the corresponding torque blocks 52. By way of example, the recesses 54 may be formed in support rings 42. The recesses 54 are sized and located to automatically receive the corresponding torque blocks 52 as the shroud sections 44 of shroud 30 are transitioned to the closed position, as illustrated in FIGS. 6-8. If the shroud 30 is a split-shroud with two shroud sections 44 connected by hinge 46, the two shroud sections 44 may be pivoted from an open position (see FIG. 6) to a closed position (see FIG. 7). The closure of the shroud sections 44 causes the torque blocks 52 to enter corresponding recesses 54 in a radial direction and to be trapped therein (see cut away view in FIG. 8) so as to counter torque loading in this area. Once the torque blocks 52 are trapped in corresponding recesses 54, a solid link is established between the shroud 30 and the base pipes 32 to which the support rings 42 are securely affixed. The shroud 30 may be secured in the closed position via suitable fasteners 56, e.g. threaded fasteners, or other types of fastening mechanisms. As a result, simple closure of the shroud 30 automatically engages the torque resistance system 50 with no additional hardware to install on the rig.

Figure 13:
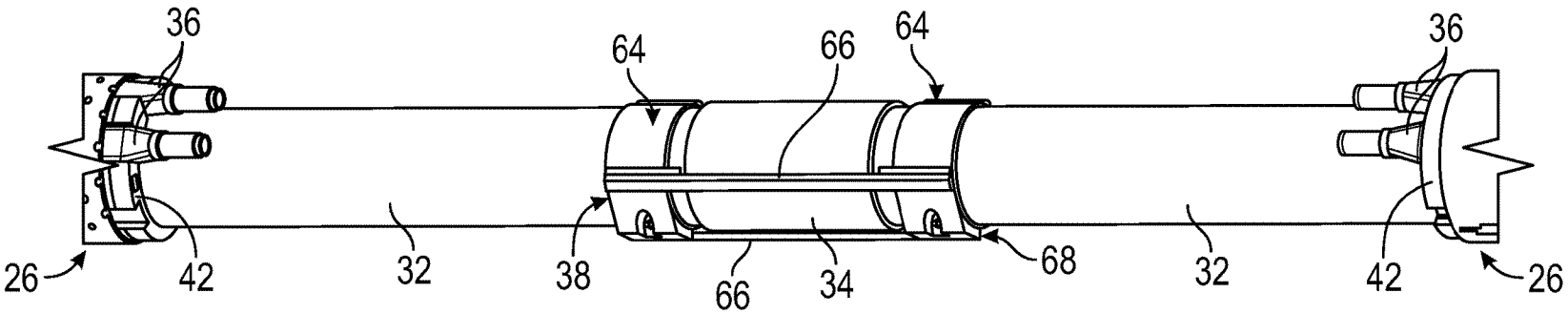
FIG. 13 is an illustration of the base pipe clamp closed and locked onto sequential base pipes across the base pipe coupling prior to installation of the jumper tubes, according to an embodiment of the disclosure.

Referring generally to FIGS. 9-12, a portion of another type of torque resistance system 50 is illustrated. In this embodiment, the torque resistance system 50 comprises a base pipe clamp 58 which may be releasably secured to one or more of the base pipes 32. By way of example, the base pipe clamp 58 may comprise clamp sections 60 which may be closed and secured to an individual base pipe 32 or to sequentially joined base pipes 32, as illustrated in FIG. 13. By way of example, the clamp sections 60 may be pivotably coupled via a clamp hinge 62. In some embodiments, the clamp sections 60 comprise clamp rings 64 connected to each other at a spaced longitudinal distance via support bars 66. The interior surface of the clamp rings 64 may have teeth 67 or other types of engagement features to resist rotation of the base pipe clamp 58 relative to the base pipes 32 after mounting. The teeth 67 may be oriented to resist torque loads applied in the counterclockwise direction.

Once the base pipe clamp 58 is closed, a latch 68 may be used to secure the clamp 58 in the closed position. By way of example, the latch 68 may comprise swing bolts 70 which can be pivoted into an engaged position and tightened so as to tighten the base pipe clamp 58 onto the corresponding base pipes 32 (see FIGS. 11-13). The base pipe clamp 58 also comprises an abutment 72 which may have a catch face 74 oriented for engagement with a feature or features on the corresponding shroud 30. In some embodiments, a timing mark 76 or a plurality of timing marks may be positioned along the exterior of the base pipe clamp 58 to ensure proper rotational alignment with respect to the base pipes 32.

Figure 14:
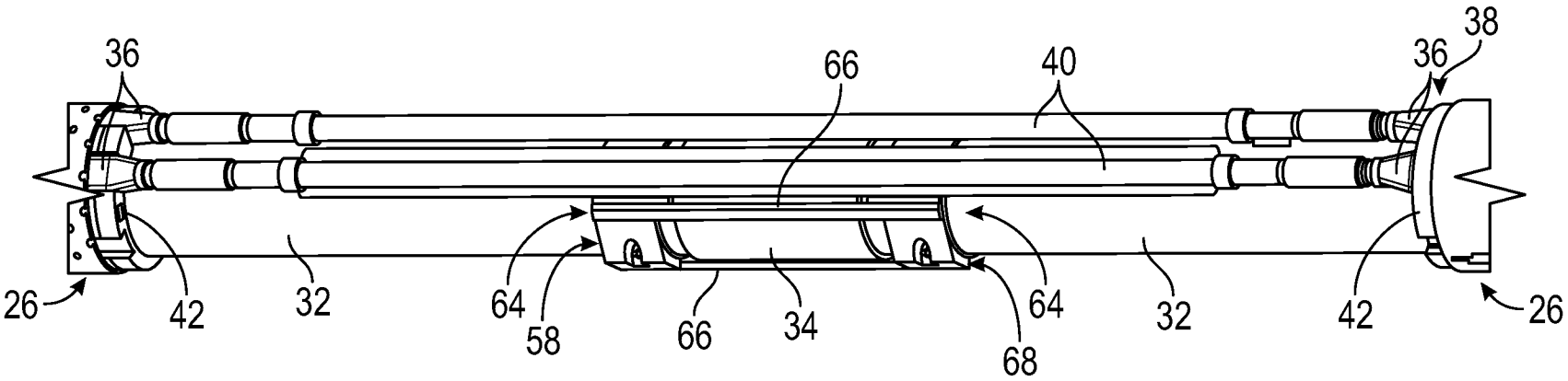
FIG. 14 is an illustration similar to that of FIG. 13 but showing the jumper tubes installed, according to an embodiment of the disclosure.
Figure 15:
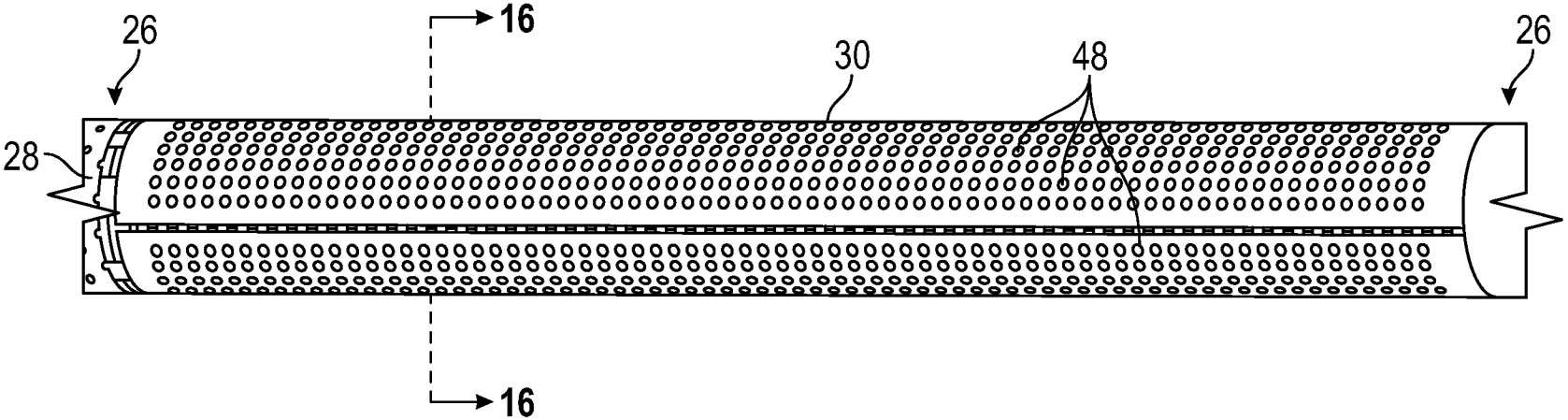
FIG. 15 is an illustration similar to that of FIG. 14 but showing the shroud installed over the base pipe coupling and the jumper tubes, according to an embodiment of the disclosure.
Figure 16:
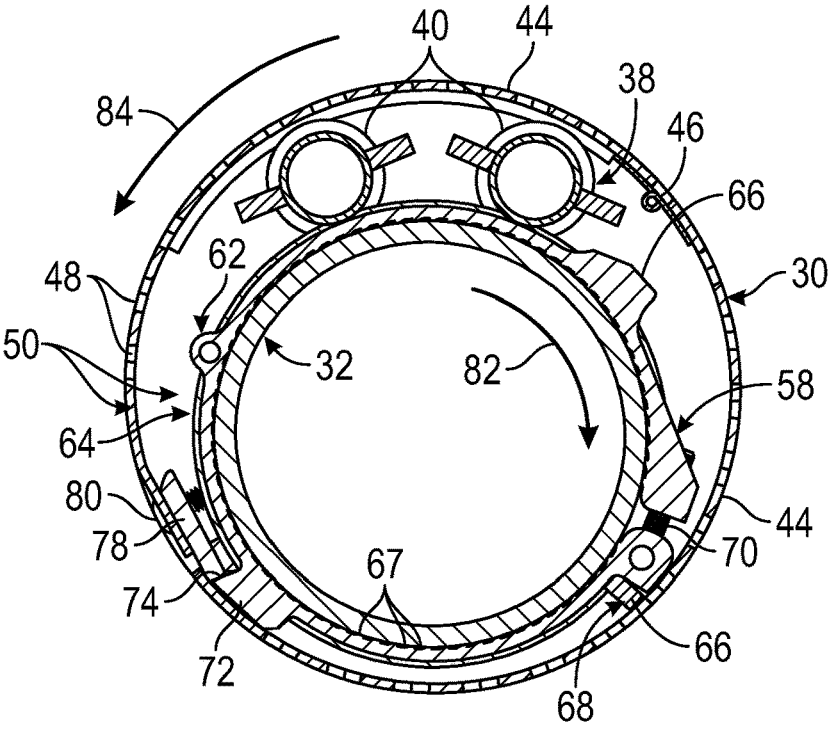
FIG. 16 is a cross-sectional view taken generally along line A-A of FIG. 15, according to an embodiment of the disclosure.

After the base pipe clamp 58 is appropriately oriented, closed, and latched to base pipes 32, the jumper tubes 40 may be installed, as illustrated in FIG. 14. As illustrated, the base pipe clamp 58 may be positioned to extend across or straddle the base pipe coupling 34 to enable fastening to both of the joined base pipes 32. Following installation of the jumper tubes 40, the shroud 30 may be closed over the jumper tubes 40, base pipe coupling 34, and the base pipe clamp 58, as illustrated in FIG. 15. In this example, the torque resistance system 50 also comprises a shroud catch member 78 secured along an interior of shroud 30 via a threaded fastener 80 or other suitable fastener, as illustrated in FIG. 16. The shroud catch member 78 is attached so as to move radially into position proximate abutment 72 when the shroud 30 is transitioned to the closed position. The timing mark 76 is useful in ensuring proper mounting of the base pipe clamp 58 to ensure a proper interface between catch face 74 and shroud catch member 78 when the shroud 30 is closed and secured about the base pipe clamp 58.

As a result, torque applied to the completion system 22, e.g. clockwise torque applied to the base pipes 32 while running in hole (see arrow 82), causes the counterclockwise reaction torque on shroud 30 (see arrow 84) to move the shroud catch member 78 against the catch face 74 of abutment 72. The abutment 72 resists further movement of the shroud catch member 78 and thus of the shroud 30. Effectively, torque resistance system 50 thus acts between the shroud 30 and the base pipe or base pipes 32 to resist unwanted torque effects in the region of shroud 30 and the jumper tubes 40 during twisting/rotation of completion system 22. It should be noted the base pipe clamp 58 may be used with already manufactured products by simply attaching the base pipe clamp 58 to system base pipes. The base pipe clamp 58 also may be used in combination with the embodiment utilizing torque blocks 52 and illustrated in FIGS. 2-8.

Figure 17:
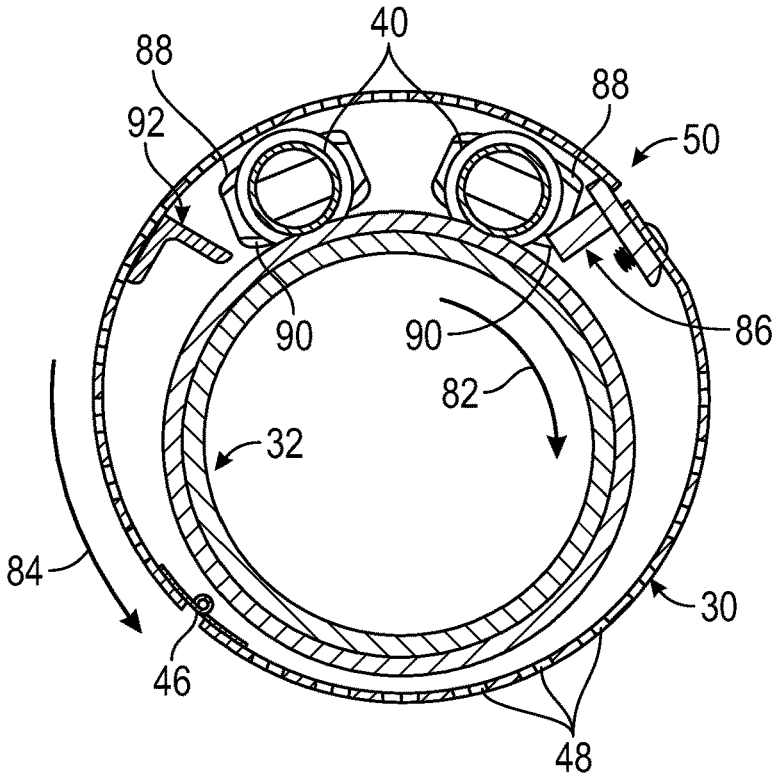
FIG. 17 is a cross-sectional view of an example of a completion system employing another type of torque resistance system, according to an embodiment of the disclosure.
Figure 18:
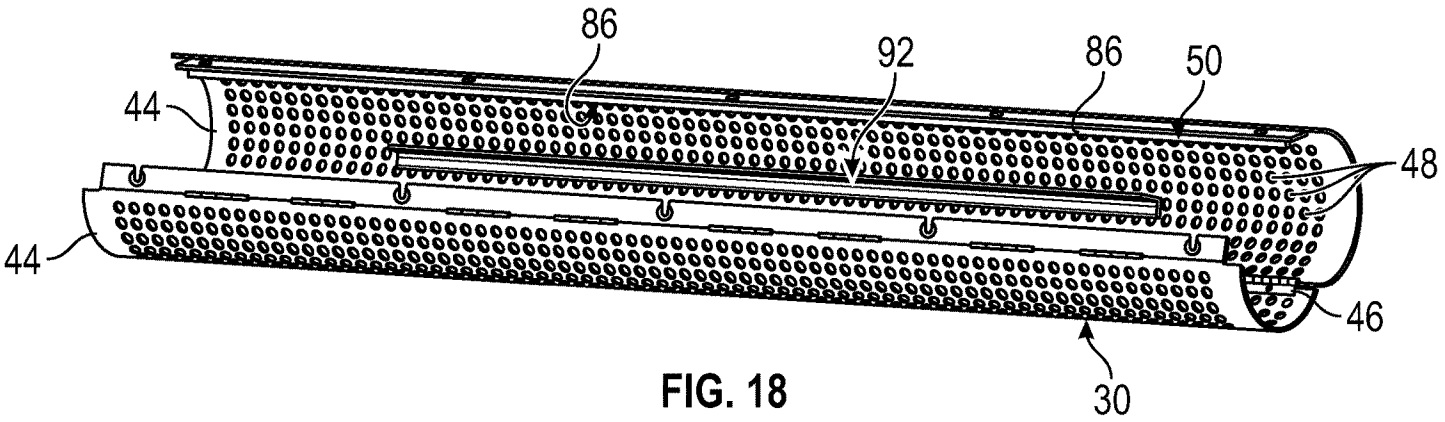
FIG. 18 is an illustration of a shroud employing a portion of the torque resistance system illustrated in FIG. 16, according to an embodiment of the disclosure.

Referring generally to FIGS. 17-18, another embodiment of torque resistance system 50 is illustrated. In this embodiment, the torque resistance system 50 comprises a torque resistant bar 86 secured to the shroud 30 lengthwise along an interior of the shroud 30. The torque resistant bar 86 may be secured via welding or other suitable fastening techniques. In this embodiment, the torque resistance system 50 also comprises abutments 88 which may be formed as alternate path mounting brackets 90, e.g. jumper tube mounting brackets. The torque resistant bar 86 is secured to shroud 30 so as to be automatically positioned proximate the brackets 90 when the shroud 30 is transitioned to the closed position illustrated in FIG. 17.

As a result, torque applied to the completion system 22, e.g. clockwise torque applied to the base pipes 32 while running in hole (see arrow 82), causes the counterclockwise reaction torque on shroud 30 (see arrow 84) to move the torque resistant bar 86 against the brackets 90. The brackets 90 resist further movement of the torque resistant bar 86 and thus of the shroud 30. Effectively, this embodiment of torque resistance system 50 also acts between the shroud 30 and the base pipe or base pipes 32 to resist unwanted torque effects in the region of shroud 30 and jumper tubes 40 during twisting/rotation of completion system 22.

In some embodiments, a jumper buckling restraint bar 92 also may be secured along the interior of shroud 30 in a lengthwise direction. With reference to FIGS. 17 and 18, the jumper buckling restraint bar 92 may be secured so that it is positioned generally lengthwise along an opposite circumferential side of jumper tubes 40. In this manner, the jumper buckling restraint bar 92 and the torque resistant bar 86 cooperate to trap the jumper tubes 40 in a manner which prevents buckling during assembly, deployment, and twisting of the completion system 22.

Figure 19:
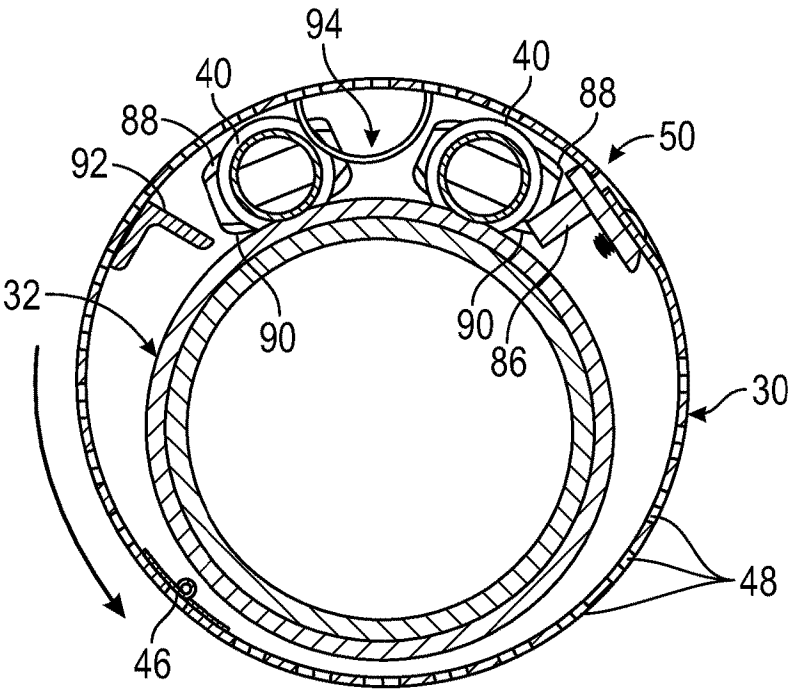
FIG. 19 is a cross-sectional view of an example of a completion system employing another type of torque resistance system, according to an embodiment of the disclosure.
Figure 20:
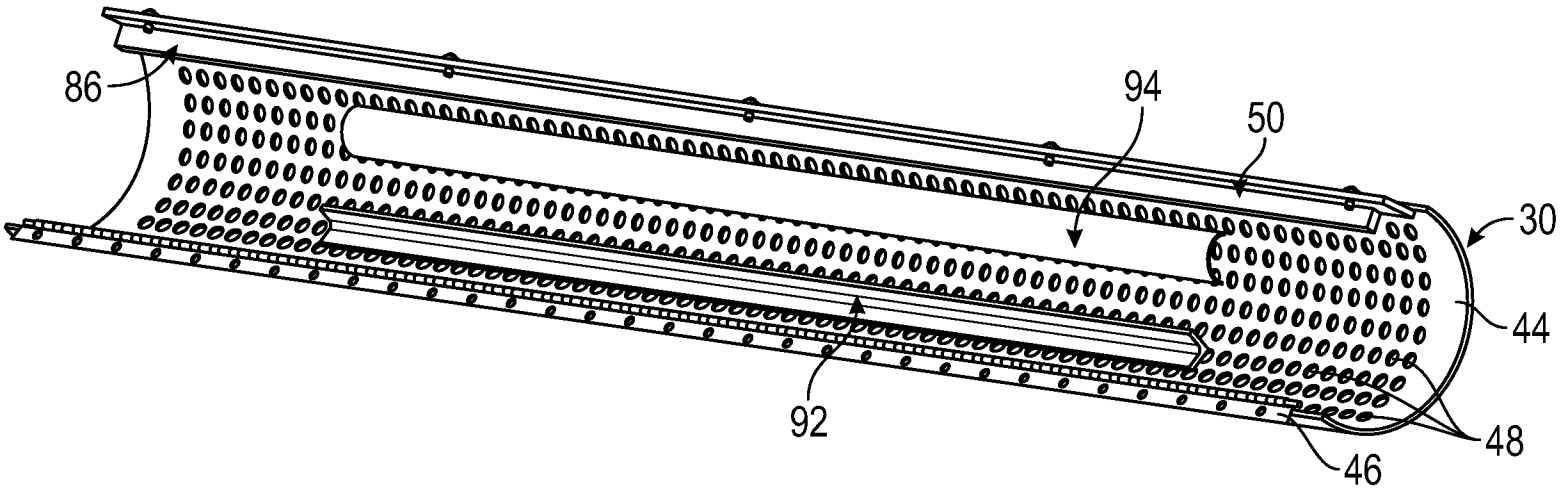
FIG. 20 is an illustration of a shroud employing a portion of the torque resistance system illustrated in FIG. 19, according to an embodiment of the disclosure.

Referring generally to FIGS. 19-20, another embodiment is illustrated which utilizes the torque resistant bar 86 and the jumper buckling restraint bar 92 described above with reference to FIGS. 17-18. In this embodiment, however, an intermediary buckling restraint bar 94 has also been secured lengthwise along the interior of shroud 30. The intermediary buckling restraint bar 94 is secured so as to be positioned generally lengthwise between adjacent jumper tubes 40 when the shroud 30 is transitioned to the closed position as illustrated in FIG. 19. Addition of the intermediary buckling restraint bar 94 can provide additional support against buckling of the jumper tubes 40 in certain types of applications.

Depending on the parameters of a given environment, wellbore, and gravel packing operation, the well completion system may comprise a variety of other and/or additional components. Similarly, the size and configuration of components described herein may be adjusted to accommodate such parameters or to provide additional or other functionality. Furthermore, a variety of screens/filters, inflow control devices, and other alternate path components may be incorporated into the screen assemblies. Various types of materials and perforation patterns may be used to provide the desired shrouds for enclosing the jumper tubes and base pipe couplings. The systems and techniques described herein may be used to enable gravel packing and/or other well treatment applications in multiple well zones in lateral or vertical wellbore sections. Additionally, various types of connectors, latches, and other fasteners may be used to attach, close, or otherwise secure various components.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a completion system having:

a first screen assembly joined with a second screen assembly, each of the first and second screen assemblies comprising a screen shroud disposed about a base pipe, the base pipes of the first and second screen assemblies being joined via a coupling;

an alternate path system disposed along the first and second screen assemblies, the alternate path system comprising shunt tubes extending along each of the first and second screen assemblies and connected via jumper tubes extending across the coupling;

a shroud having a plurality of shroud sections positioned around the jumper tubes; and a torque resistance system acting between the shroud and the base pipes to resist torque effects in a region of the jumper tubes during rotation of the completion system, the torque resistance system being automatically engaged as the plurality of shroud sections are moved toward each other during mounting of the shroud about the jumper tubes.

2. The system as recited in claim 1, wherein the torque resistance system comprises a plurality of torque blocks secured along an interior of the shroud, the plurality of torque blocks being sized for receipt in corresponding recesses formed in support rings coupled to at least one of the base pipes.

3. The system as recited in claim 2, wherein the plurality of torque blocks comprises two torque blocks having different lengths with respect to each other.

4. The system as recited in claim 1, wherein the torque resistance system comprises a base pipe clamp releasably secured to at least one of the base pipes, the base pipe clamp having an abutment oriented to engage a catch member secured along an interior of the shroud.

5. The system as recited in claim 4, wherein the base pipe clamp extends across the coupling and is secured to the base pipes of both the first and second screen assemblies.

6. The system as recited in claim 4, wherein the base pipe clamp comprises a pair of base pipe clamp sections connected to each other via a hinge.

7. The system as recited in claim 1, wherein the torque resistance system comprises a torque restraint bar secured to the shroud lengthwise along an interior of the shroud, the torque restraint bar being positioned to engage brackets supporting the alternate path system.

8. The system as recited in claim 7, wherein the brackets comprise jumper tube support brackets.

9. The system as recited in claim 7, further comprising a jumper tube buckling restraint bar secured along the interior of the shroud at a position to resist buckling of the jumper tubes.

10. The system as recited in claim 9, wherein the jumper tube buckling restraint bar comprises a plurality of jumper tube buckling restraint bars.

11. The system as recited in claim 1, wherein the plurality of shroud sections comprises two shroud sections connected to each other by a shroud hinge.

12. A system, comprising:

a completion system for use downhole, the completion system comprising an alternate path system having jumper tubes extending across a coupling connecting sequential base pipes, the jumper tubes being enclosed by a split shroud having shroud sections which may be opened about a shroud hinge and then pivoted toward each other to transition the shroud to a closed position over the jumper tubes, the shroud and the jumper tubes being protected against 8 torsional effects by a torque resistance system which is automatically engaged between the shroud and at least one of the base pipes as the shroud sections are pivoted to the closed position.

13. The system as recited in claim 12, wherein the torque resistance system comprises a plurality of torque blocks secured along an interior of the shroud, the plurality of torque blocks being sized for receipt in corresponding recesses formed in support rings coupled to at least one of the base pipes.

14. The system as recited in claim 12, wherein the torque resistance system comprises a pipe clamp releasably secured to at least one of the base pipes, the pipe clamp having an abutment oriented to engage a catch member secured along an interior of the shroud.

15. The system as recited in claim 12, wherein the torque resistance system comprises a torque restraint bar secured to the shroud lengthwise along an interior of the shroud, the torque restraint bar being positioned to engage brackets supporting the jumper tubes.

16. The system as recited in claim 13, wherein the torque resistant system also comprises a pipe clamp releasably secured to at least one of the base pipes, the pipe clamp having an abutment oriented to engage a catch member secured along the interior of the shroud.

17. A method, comprising:

providing a completion system with alternate path shunt tubes positioned 3 along a first base pipe and a second base pipe;

joining the base pipes at a base pipe coupling;

connecting the alternate path shunt tubes along the first base pipe with the alternate path shunt tubes along the second base pipe via jumper tubes;

enclosing the base pipe coupling and the jumper tubes with a shroud by closing shroud sections of the shroud; and automatically engaging a torque resistance system between the shroud and the base pipe via closing of the shroud sections.

18. The method as recited in claim 17, further comprising deploying the completion system downhole into a wellbore.

19. The method as recited in claim 18, further comprising rotating the completion system without detrimental torque effects on the shroud or the jumper tubes due to engagement of the torque resistance system.

* * * * *